US010233729B2

(12) United States Patent
Caldwell

(10) Patent No.: US 10,233,729 B2
(45) Date of Patent: Mar. 19, 2019

(54) APPARATUS AND METHOD FOR ISOLATING AND SECURING AN UNDERWATER OIL WELLHEAD AND BLOWOUT PREVENTER

(71) Applicant: William Matthew Caldwell, Ocean Springs, MS (US)

(72) Inventor: William Matthew Caldwell, Ocean Springs, MS (US)

( * ) Notice: Subject to any disclaimer, the term of this patent is extended or adjusted under 35 U.S.C. 154(b) by 0 days.

(21) Appl. No.: 15/596,849

(22) Filed: May 16, 2017

(65) Prior Publication Data

US 2017/0247987 A1 Aug. 31, 2017

Related U.S. Application Data

(63) Continuation of application No. 14/323,985, filed on Jul. 3, 2014, now Pat. No. 9,650,874, which is a continuation of application No. 13/168,308, filed on Jun. 24, 2011, now Pat. No. 8,887,812.

(60) Provisional application No. 61/358,662, filed on Jun. 25, 2010.

(51) Int. Cl.
*E21B 43/01* (2006.01)
*E21B 33/037* (2006.01)

(52) U.S. Cl.
CPC ..... *E21B 43/0122* (2013.01); *E21B 33/037* (2013.01)

(58) Field of Classification Search
CPC ..... E21B 43/0122; E21B 33/037
See application file for complete search history.

(56) References Cited

U.S. PATENT DOCUMENTS

| | | | | | |
|---|---|---|---|---|---|
| 3,247,672 | A * | 4/1966 | Johnson | B63C 11/44 | 166/351 |
| 3,443,643 | A * | 5/1969 | Jones | E21B 21/08 | 138/45 |
| 4,046,191 | A * | 9/1977 | Neath | E21B 21/001 | 166/352 |
| 5,582,252 | A * | 12/1996 | Richmond | B63B 27/24 | 166/352 |
| 6,817,421 | B2 * | 11/2004 | Dallas | E21B 33/068 | 166/379 |
| 6,938,695 | B2 * | 9/2005 | Williams | E21B 33/038 | 166/341 |
| 7,011,152 | B2 * | 3/2006 | Soelvik | E21B 7/128 | 166/352 |
| 8,776,894 | B2 * | 7/2014 | Orbell | E21B 17/085 | 166/345 |
| 2014/0190701 | A1 * | 7/2014 | Humphreys | E21B 17/017 | 166/345 |

* cited by examiner

*Primary Examiner* — Matthew R Buck
*Assistant Examiner* — Aaron L Lembo
(74) *Attorney, Agent, or Firm* — Eldredge Law Firm, LLC; Richard Eldredge; Beth Felix

(57) ABSTRACT

A drilling package for an offshore wellbore having a wellhead, said drilling package comprising in a functional order a shear module situated above said wellhead and in fluid communication with said wellbore; a blowout preventer in fluid communication with the shear module; a lower marine riser package in fluid communication with the blowout preventer; and a bypass valve and port in a normal fluid path upstream of a well closure device that is actuated to divert flow from the normal path through the blowout preventer to an alternative flow path.

7 Claims, 17 Drawing Sheets

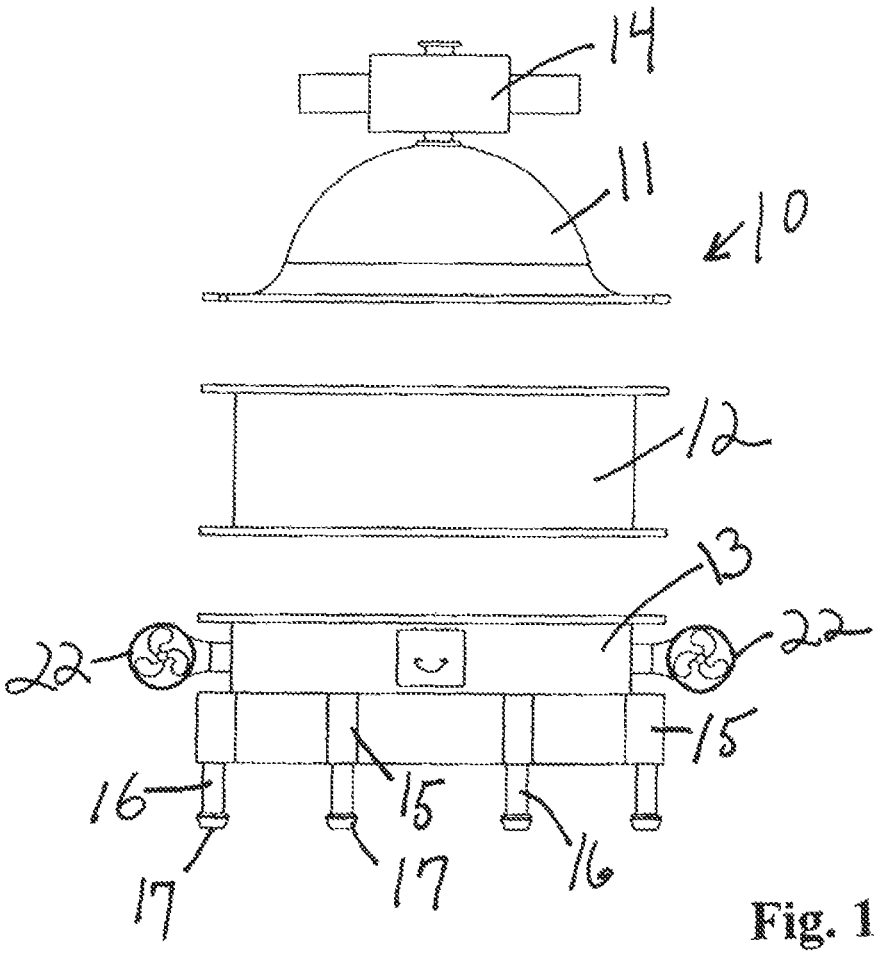
Fig. 1
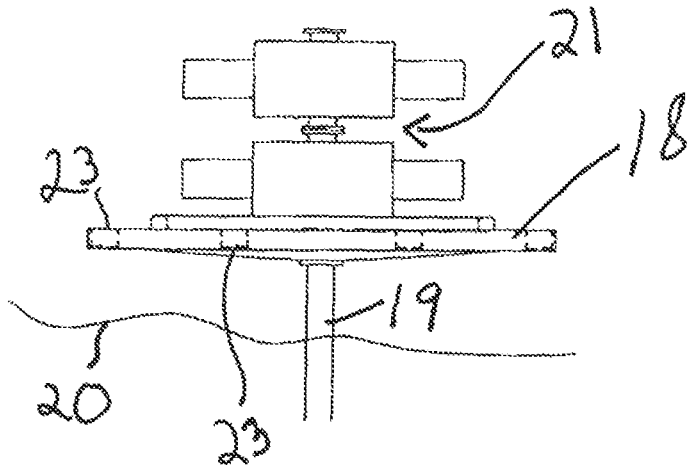

APPARATUS AND METHOD FOR ISOLATING AND SECURING AN UNDERWATER OIL WELLHEAD AND BLOWOUT PREVENTER

CROSS-REFERENCE TO RELATED APPLICATION

This application is a continuation of U.S. application Ser. No. 13/168,308, filed Jun. 24, 2011, which claims the benefit of U.S. Provisional Application No. 61/358,662, filed on Jun. 25, 2010, which is hereby incorporated by reference in its entirety.

FIELD OF THE INVENTION

This invention relates to devices fir stopping or preventing fluids leaking from oil wellheads and related structures and, more particularly, to a wellhead fluid containment system consisting of a containment dome and seal plate sealed together by compression and providing a method for isolating and securing a deepwater wellhead in case of failure.

BACKGROUND OF THE INVENTION

As demand for oil has increased, oil companies have developed devices and methods to allow deepwater drilling. With drilling platforms used today, oil companies have, been able to drill wells at depths that exceed over a mile below the water surface. However, the oil and gas industry has failed to develop an efficient method for isolating and securing the wellhead and blowout preventer in the event of a catastrophic failure, such as encountered recently by the Deepwater Horizon rig operated by British Petroleum (BP). BP made several unsuccessful attempts to terminate or capture the oil and gas escaping into the Gulf of Mexico by placing a containment dome over the leaking wellhead. There are several problems with placing an unsealed containment dome over a leaking wellhead, such as oil escaping from around the unsealed bottom and hydrates forming inside the dome and thereby blocking the lines used to collect the leaking oil.

SUMMARY OF THE INVENTION

The present invention provides a containment system for an oil wellhead having a seal plate attached to a wellhead casing or riser, a containment dome that fits on the seal plate, and a compression mechanism which compresses the seal plate and the containment dome together to collect and control fluids leaking from devices attached to the wellhead. In use, fluids leaking from an oil wellhead are contained by installing the seal plate on a wellhead casing or riser, lowering the containment dome onto the seal plate, sealing the seal plate to the containment dome by compressing the seal plate and containment dome together, and collecting, containing, and regulating fluids leaking from the wellhead casing or riser, or from devices contained within the containment dome.

Another embodiment of the containment system has a seal plate attached to a wellhead casing or riser, a containment dome that fits on the seal plate wherein the containment dome has a wellhead patch, and a compression mechanism which compresses the plate and the containment dome together to collect and control fluids leaking from devices attached to the wellhead. In use, the seal plate is installed on a wellhead casing or riser. The containment dome having the wellhead patch is lowered onto the seal plate, the seal plate is sealed to the containment dome by compressing them together, and the wellhead patch is extended into a bore of a blowout preventer (BOP) to lock and seal the bore.

Another embodiment of the containment system has a first seal plate attached to a marine riser, a first containment dome that fits on the first seal plate, a compression mechanism which compresses the seal plate and the containment dome together to collect and control fluids leaking from the marine riser, a second seal plate attached to a wellhead casing or riser, and a second containment dome that fits over the first containment dome and the first seal plate, encapsulating a portion of the first containment dome and the first seal plate. The second containment dome has a second compression mechanism which compresses the second seal plate and the second containment dome together to collect and control fluids leaking from devices attached to the wellhead. In use, the first seal plate is installed to a marine riser. The second seal plate is installed to a wellhead casing or riser. A first containment dome is lowered on to the first seal plate, and the first seal plate and the first containment dome are compressed together to collect, control, and regulate fluids leaking from the marine riser. The second containment dome is lowered over the first containment dome and the first seal plate, encapsulating a portion of the first containment dome and the first seal plate. The second containment dome is also lowered on to the second seal plate. The second seal plate and the second containment dome are compressed together to collect, control, and regulate fluids leaking from devices contained within the containment dome.

An advantage of the present invention is a simple method of rapidly placing a containment dome around a leaking portion of an oil wellhead system to prevent oil spills and contamination.

Another advantage is a simple method of confining the leaking oil within a containment dome by sealing the containment dome to a seal plate by compressing the containment dome and seal plate together.

Another advantage is a seal plate that can be attached to an oil wellhead casing or riser during construction of the wellhead or that can be attached to an existing wellhead casing or riser.

Another advantage is a containment dome that can provide a wellhead patch to a wellhead system wherein the wellhead patch can interface with a capping stack.

Another advantage is the ability to inject chemicals into the containment dome, such as methanol, to prevent hydrates from forming.

Another advantage is that the containment dome may be constructed for zero, plus, or minus buoyancy.

Another advantage is that all aspects of controlling and operating an oil wellhead can be performed through the containment dome and seal plate, and all aspects of installation, regulation, and control of the containment dome can be performed by remote operating vehicles (ROVs) under water.

BRIEF DESCRIPTION OF THE DRAWINGS

FIG. 1 is an exploded view of an embodiment of the containment system of the present invention having a containment dome and a seal plate.

DETAILED DESCRIPTION OF THE INVENTION

Figure 2:
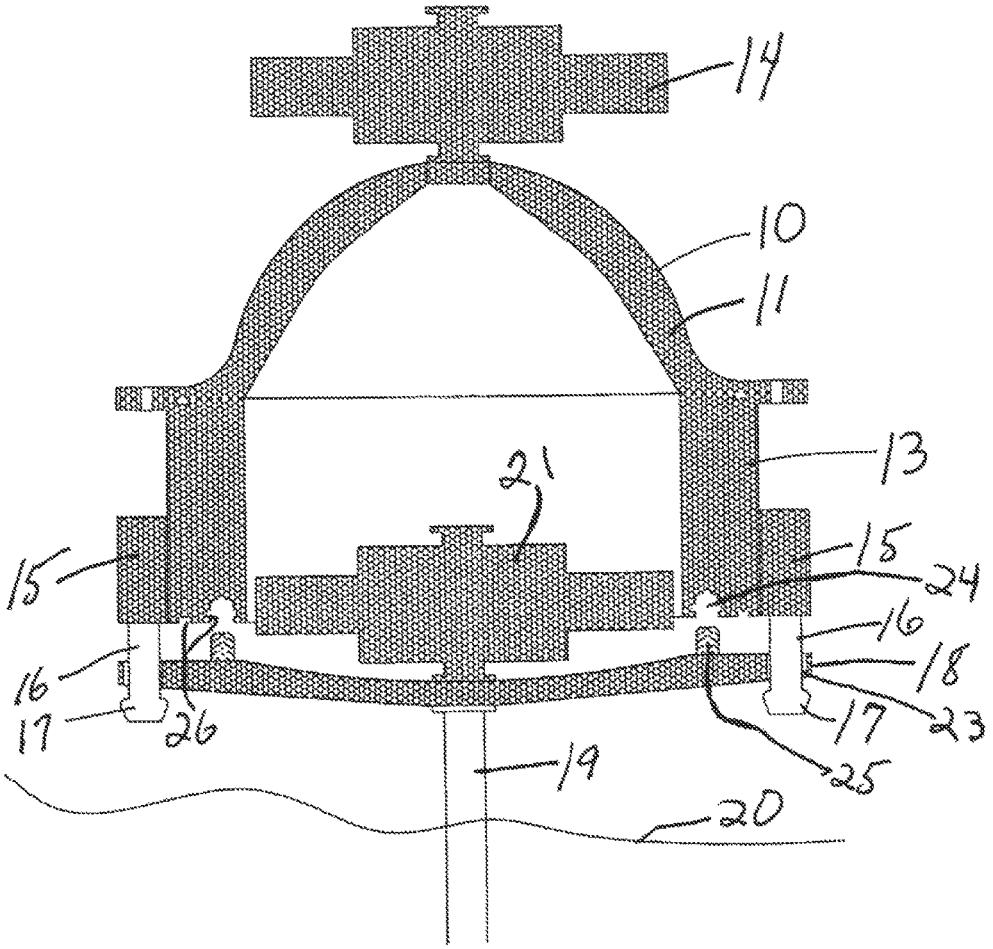
FIG. 2 is a cross-sectional view of a smaller containment dome having a top section and a base.

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

The present invention is a containment dome and seal plate providing a method for isolating and securing a deepwater wellhead and associated drilling and completion systems in case of failure. The containment dome and seal plate provide a containment system which will provide a standard for isolating and securing a wellhead at the sea floor and for preventing oil spills. The containment dome is sealed to the seal plate by a compression locking mechanism, thereby isolating the wellhead from the environment while supporting additional natural drive forces for the delivery of the well effluent to the surface support vessel. The containment dome serves as a remotely operated underwater vehicle (ROV) having a base engaging a seal plate preferably mounted about the oil well casings subjacent to a blowout preventer (BOP).

The containment dome top preferably comprises a plurality of access ports that serve as vents or used for injecting chemical inhibitors such as methanol to prevent hydrates from forming while the containment dome is being secured to the seal plate or thereafter. The containment dome base has mechanisms to lock the dome base to the seal plate. It may further have a plurality of underwater cameras and lights so that the alignment of the base with the seal plate can be visually and remotely observed for remote control of the containment dome. The containment dome base may include an exterior module located beneath the base plate or on the containment dome that provides remote operation of encapsulated well components.

The system has provision for enhanced instrumentation of the drilling system to provide early warning of well control anomalies, and once a well control scenario is auctioned, can provide reliable data to the operator of the condition of the well.

In use, with the seal plate in place around the oil well casings, drilling of the wellbore may be performed as normal. However, in the event of a leak the containment dome of the present invention may be lowered and attached to the seal plate as described and shown herein, thereby isolating the wellhead and BOP. The leaking oil can either be contained within the containment dome or diverted out of the containment dome as desired.

A flange seal plate may be attached to the top of a BOP wherein the flange seal plate is a smaller version of the seal plate described above. Having both the seal plate and the flange seal plate provides an option to either isolate the entire wellhead or just the top of the BOP.

A combination of routine drilling services for the well bore may be installed on a wellhead seal plate prior to drilling operations. The drilling rig BOP and marine riser system shall land and attach to the top of the seal plate. These devices may be controlled through the drilling BOP control system, or by any other means permanently installed or connected by robotic tooling, during those periods when the primary drilling BOP control system is dysfunctional. Also, these devices may be constructed to include such drill related services as: riser fluid circulation support, dual gradient drilling systems, enhanced instrumentation for well control management, temporary well capping, and the like.

The containment system can carry and install a wellhead patch, capable of directing well fluids from both the containment enclosure and/or gripping and sealing within the BOP main bore such that a full working pressure of the BOP can be achieved through the wellhead patch to a re-entry or capping stack.

Containment Construction

FIG. 1 shows an illustration of an embodiment of the containment system of the present invention. The containment dome 10 has a top section 11, a middle section 12, and a base 13. The base 13 of the containment dome 10 engages a sealing plate 18 which is attached to the well casing 19 embedded in the sea floor 20. The seal plate 18 is shown having a pair of BOPS (stacked). If these BOPs are damaged or leaking then oil spill can be prevented by covering them with the containment dome 10. The upper section 11 of the containment dome is shown having a replacement BOP 14. Although the containment dome 10 is shown in sections it can be constructed as a single unit of base, midsection, and top section. Base 13 is shown as having hydraulic cylinders 15 with rams 16. The tips of rams 16 have conical heads 17 wherein the maximum diameter of the heads 17 is greater than the diameter of the rams 16. Seal plate 18 is shown as having ram slots 23 which are wider at one end to accommodate the maximum diameter of the conical heads 17 and narrower at the opposite end which accommodates the diameter of the ram 16 but the conical head 17 cannot pass through the narrower opposite end (see FIG. 7). The base 13 has hydraulic rotation mechanisms 22 consisting of propellers which will rotate the base clockwise or counterclockwise relative to the seal plate 18. The conical heads 17 can be inserted through the wider end of the ram slots 23 and the base 13 is rotated so that the rams 16 enter into the narrow end of the ram slots. The ram slots 23 can be retrieved into the hydraulic cylinders 15 and the conical heads 17 will compress the base 13 onto the seal plate 18 by the force of the hydraulic cylinders 15. A seal is therefore formed between the base 13 of the containment dome 10 and the seal plate 18 by compression. The containment dome is preferably constructed of carbon composite materials to provide maximum strength-weight control but not limited to using only carbon composite materials. Any material that meets required specifications suitable for well conditions may be used. The seal plate 18 is attached to well casings or pipe 19 by either bolts or an industry standard quick connect.

Figure 3:
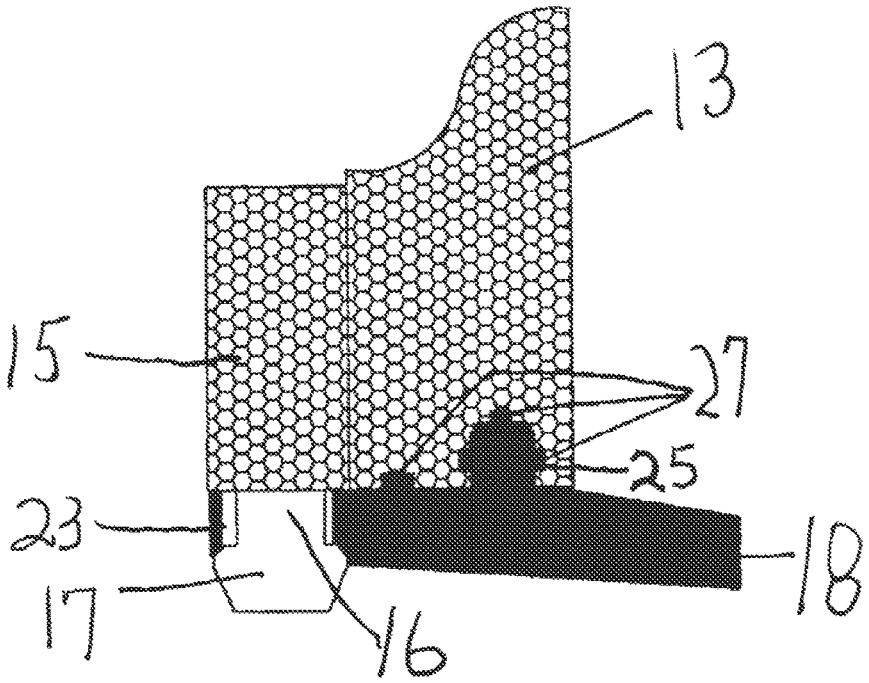
FIG. 3 is a detailed cross-sectional view of the edge of the base of a containment dome and seal plate.
Figure 4:
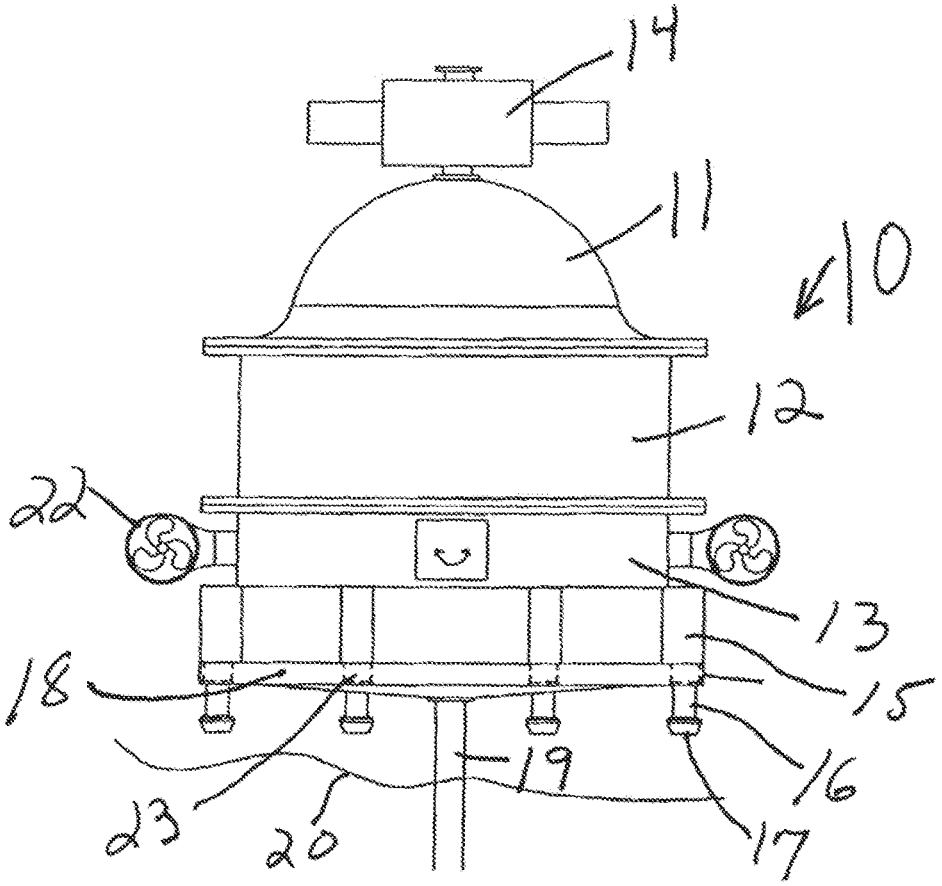
FIG. 4 shows a containment dome in position on a seal plate with rams inserted through ram slots in the seal plate to compress the containment dome and seal plate together.
Figure 5:
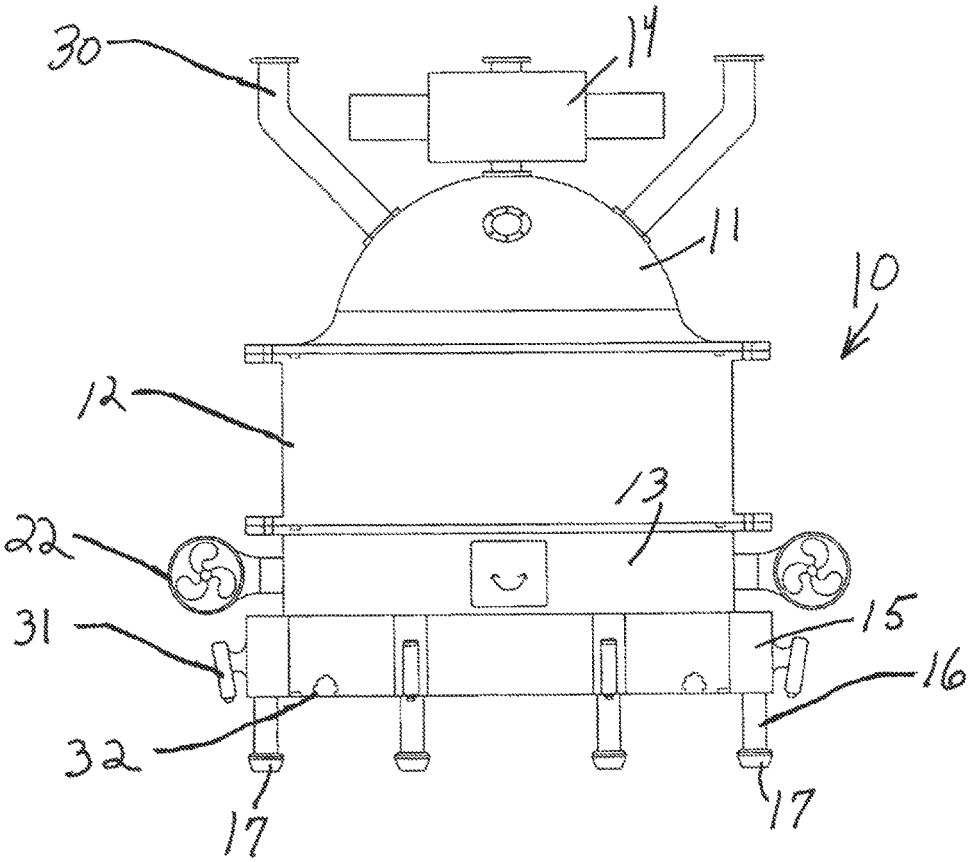
FIG. 5 shows a containment dome having additional features such as vents or injection ports and a base of the containment dome having additional features such as video cameras and high pressure spray nozzles for clearing the wellhead or casings.
Figure 6:
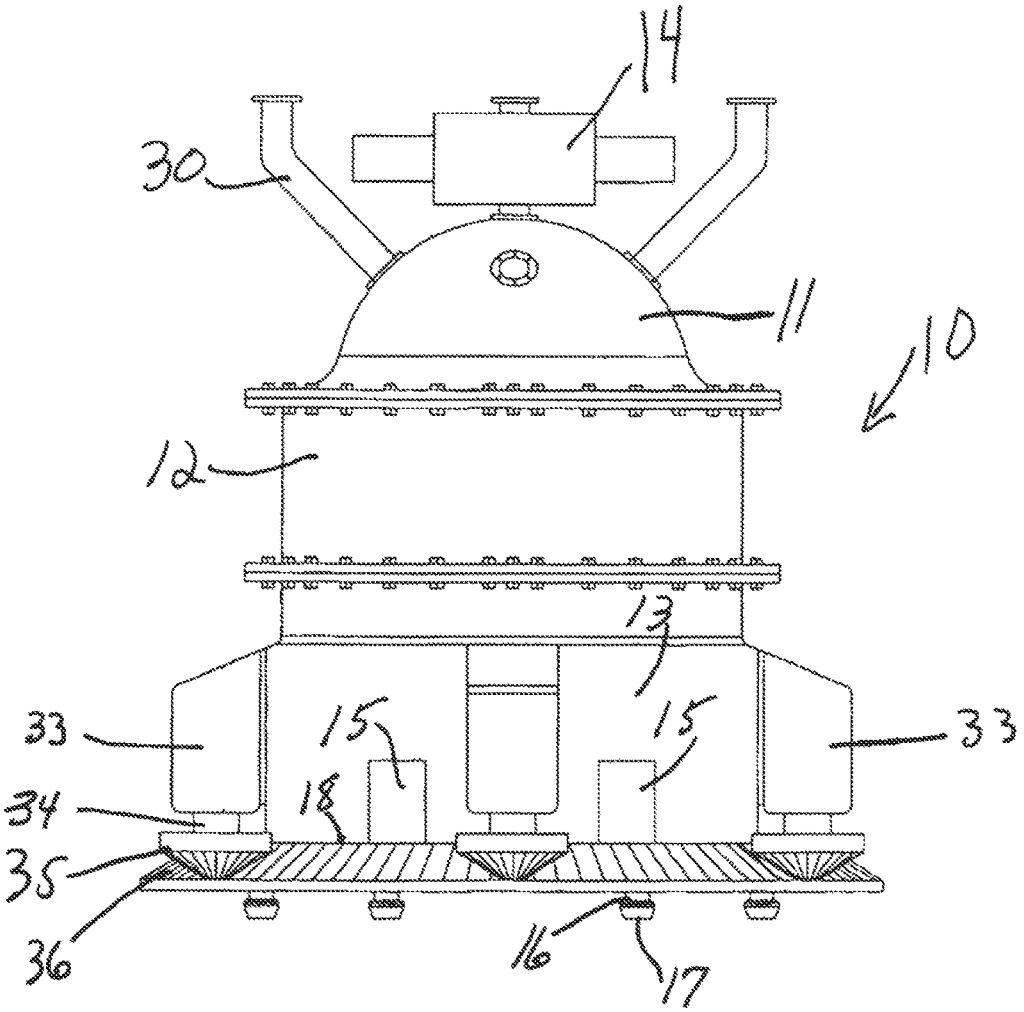
FIG. 6 shows an alternate embodiment of the containment dome base having hydraulic rotating mechanisms with rams which have ring gears.
Figure 7:
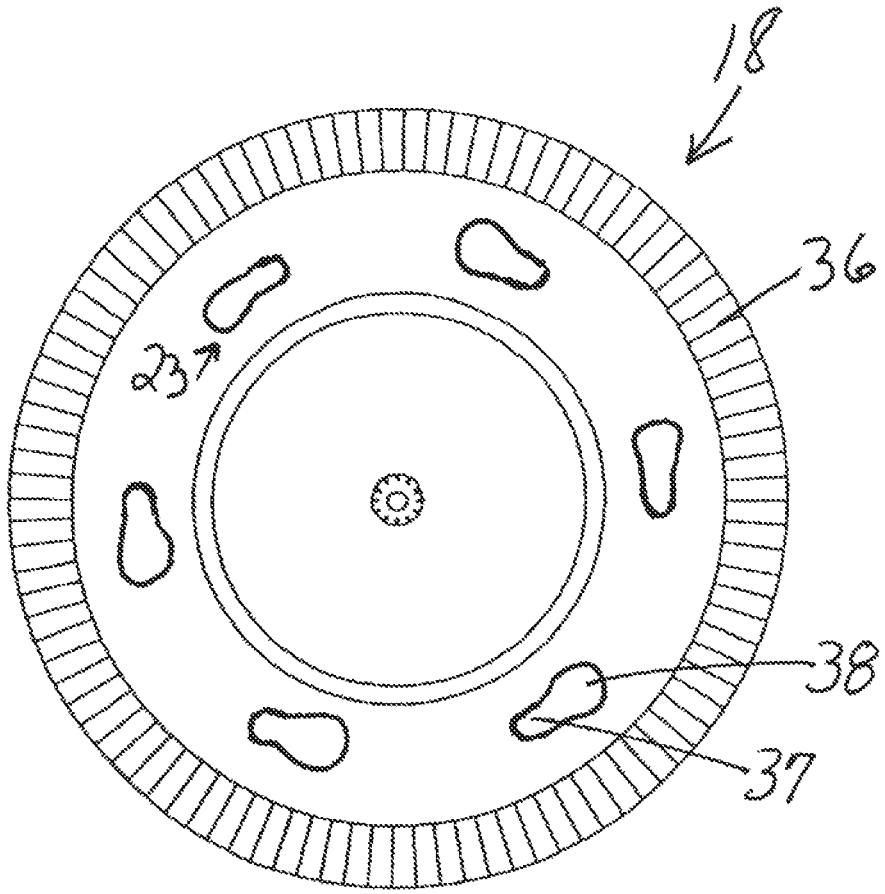
FIG. 7 shows a top view of a seal plate and its circumferential ring.

FIG. 2 illustrates a cross section of a smaller containment dome 10 having a top section 11 and a base 13. The seal plate 18 has an annular flange 25 which fits into an annular recess 24 in the bottom of the base 13. Rams 16 are shown inserted into ram slots 23. Base 13 may also have recesses 26 to accommodate O-rings. FIG. 3 illustrates a detailed view of the edges of base 13 and seal plate 18. The annular flange 25 is shown inserted into the annular recess 24 and O-rings 27 are shown positioned into recesses 26. The ram 16 is shown withdrawn into the hydraulic cylinder 15 so that the conical head 17 causes the seal plate 13 to be compressed against the base 13. FIG. 4 also shows the containment dome 10 in position on the seal plate 18 with the rams 16 inserted through the ram slots 23. FIG. 5 shows that the containment dome 10 can have additional features such as vents or injection ports 30 and the base 13 can have additional features such as video cameras 31 and high pressure spray nozzles 32 for clearing the wellhead or casings. FIG. 6 shows an alternate embodiment of the base 13 having hydraulic rotating mechanisms 33 with rams 34 which have ring gears 35. The ring gears 35 engage a circumferential ring gear 36 on the seal plate 18. Rotation of the rams 34 by the hydraulic rotating mechanisms 33 can rotate the base 13 clockwise or counter clockwise relative to the seal plate 18. FIG. 7 shows a top view of the seal plate 18 and its circumferential ring gear 36. Ram slots 23 are also shown. The conical heads 17 are inserted through the larger opening 38 of the ram slot 23 and then the base 13 is rotated so that the rams 16 are moved into the smaller openings 37 of the ram slots 23. The rams 16 can then be withdrawn into the hydraulic cylinders 15 causing the base 13 of the containment dome 10 and the seal plate 18 to be compressed together.

Figure 8:
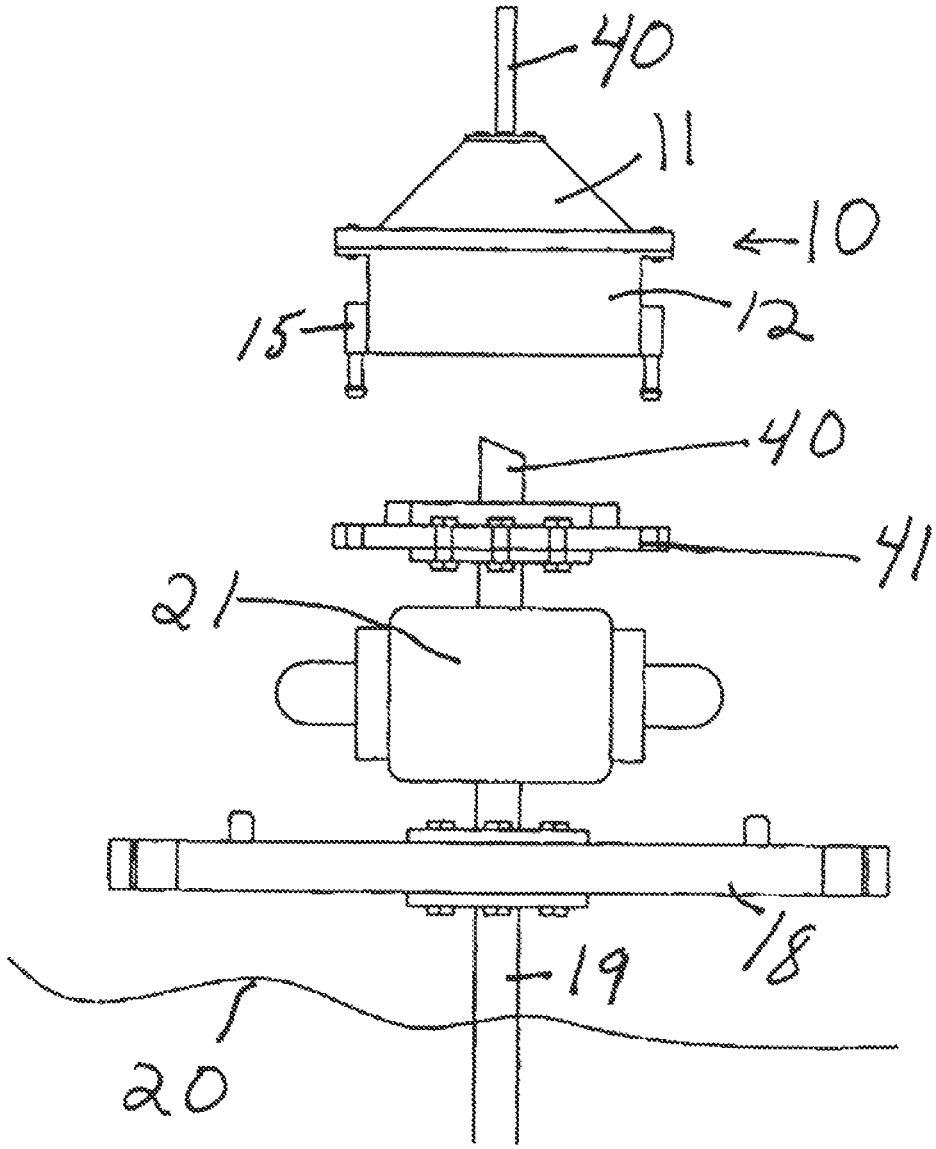
FIG. 8 shows an embodiment wherein a seal plate is in the form of a flange seal plate which can be fastened to a riser above a BOP.

FIG. 8 shows an embodiment where a seal plate is in the form of a flange seal plate 41 which can be fastened to a riser 40 above the BOP 21. This will allow the placement of a small containment dome 10 to enclose a cut riser above the BOP 21.

Figure 9:
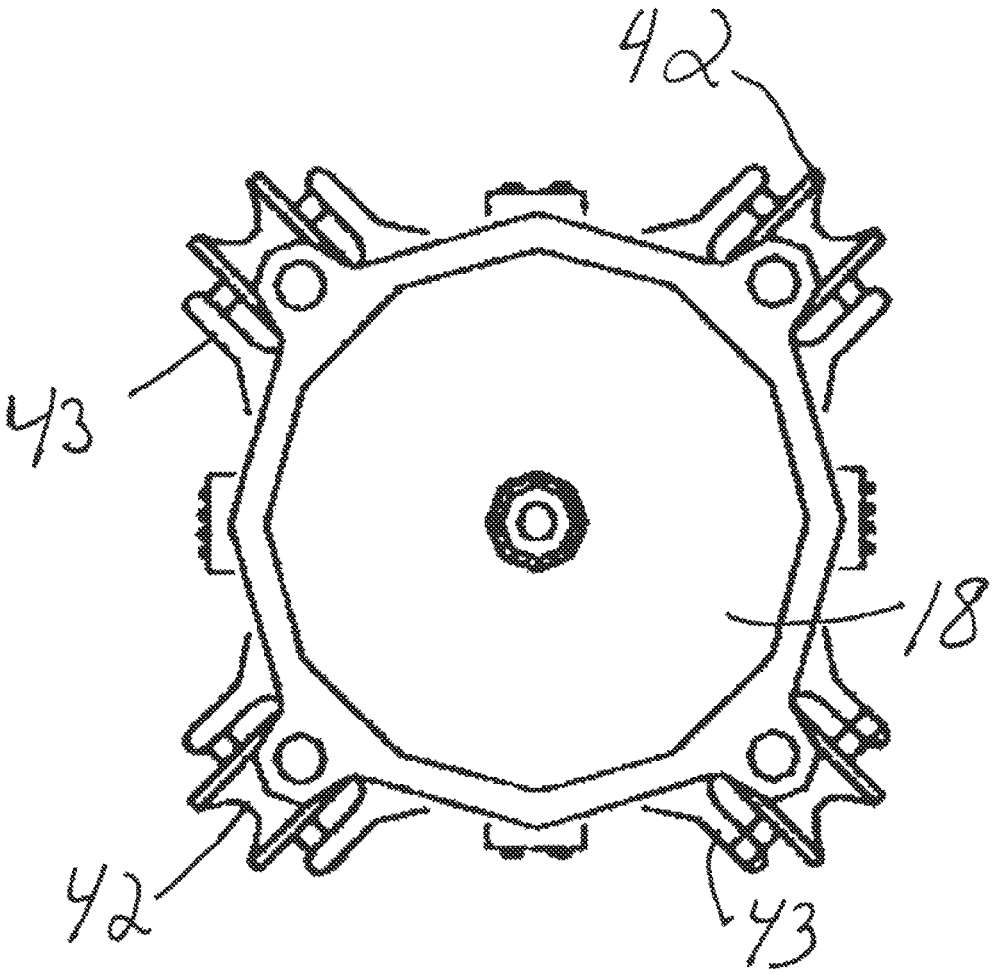
FIG. 9 shows an alternate embodiment of a seal plate which has pulleys on its perimeter.
Figure 10:
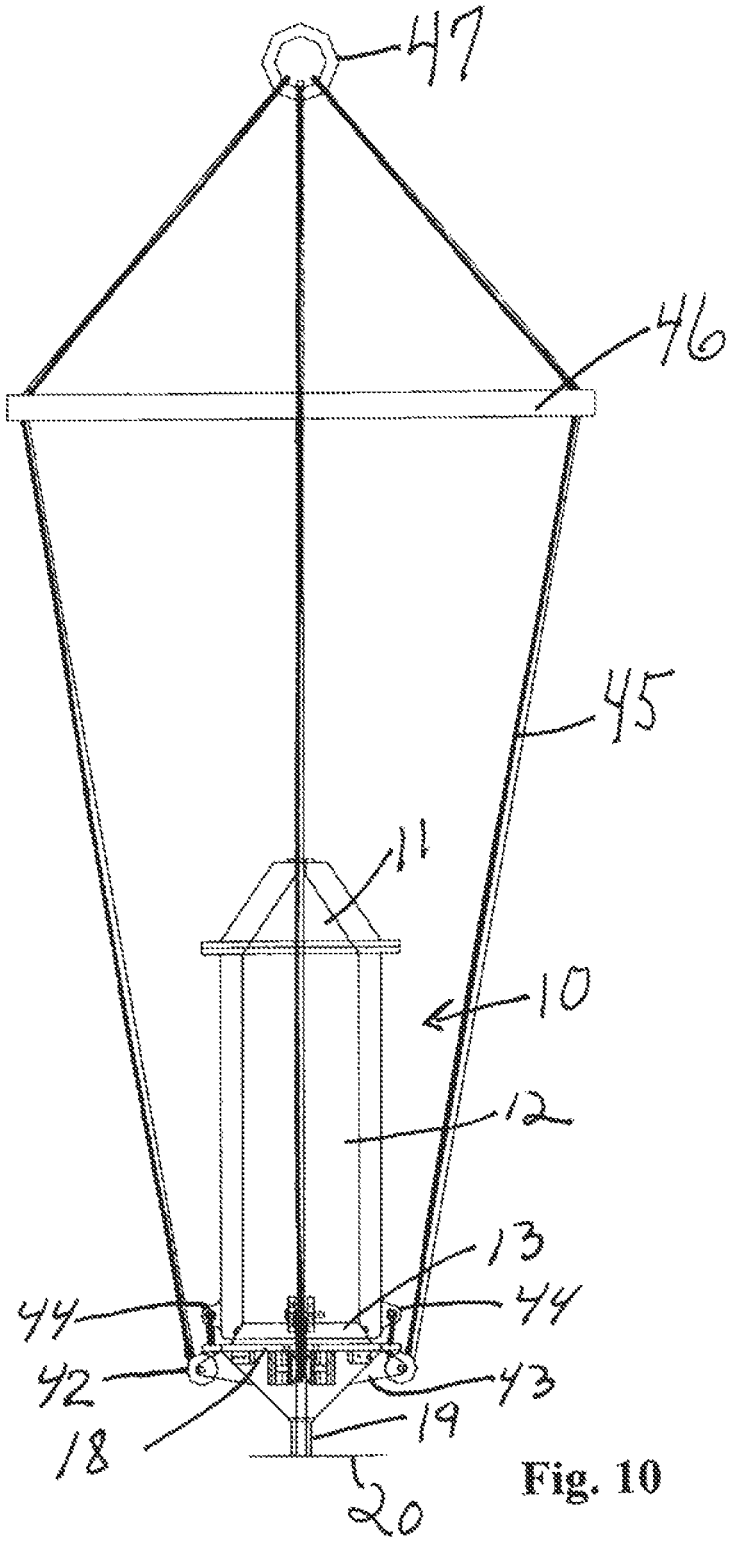
FIG. 10 shows a containment dome having cable connectors attached at its base.

FIG. 9 shows an alternant embodiment of a seal plate 18 which has pulleys 42 on its perimeter. The pulleys 42 are supported by support members 43 on the seal plate 18. FIG. 10 shows a containment dome 10 having cable connectors 44 attached at its base 13. Cables 45 are connected to the cable connecters 44, inserted around the pulleys 42, and extended upwards to a buoyancy control device 46 and cable connecting ring 47. As the buoyancy control device 46 rises to the surface the containment dome 10 will lower on to seal plate 18. Continued upward force on the cables 45 will compress the containment dome 10 and seal plate 18 together. Other methods may also be used to secure the containment dome 10 to the seal plate 18. For example, the containment dome 10 may have a plurality of connection points for attaching cables to sea anchors for the purpose of winching and compressing the containment dome 10 against the seal plate 18. In addition, locking pins or bolts may be inserted through the base 13 and the seal plate 18 and tightened to compress the base 13 onto seal plate 18.

Shear Ram Module Basis

Figure 11:
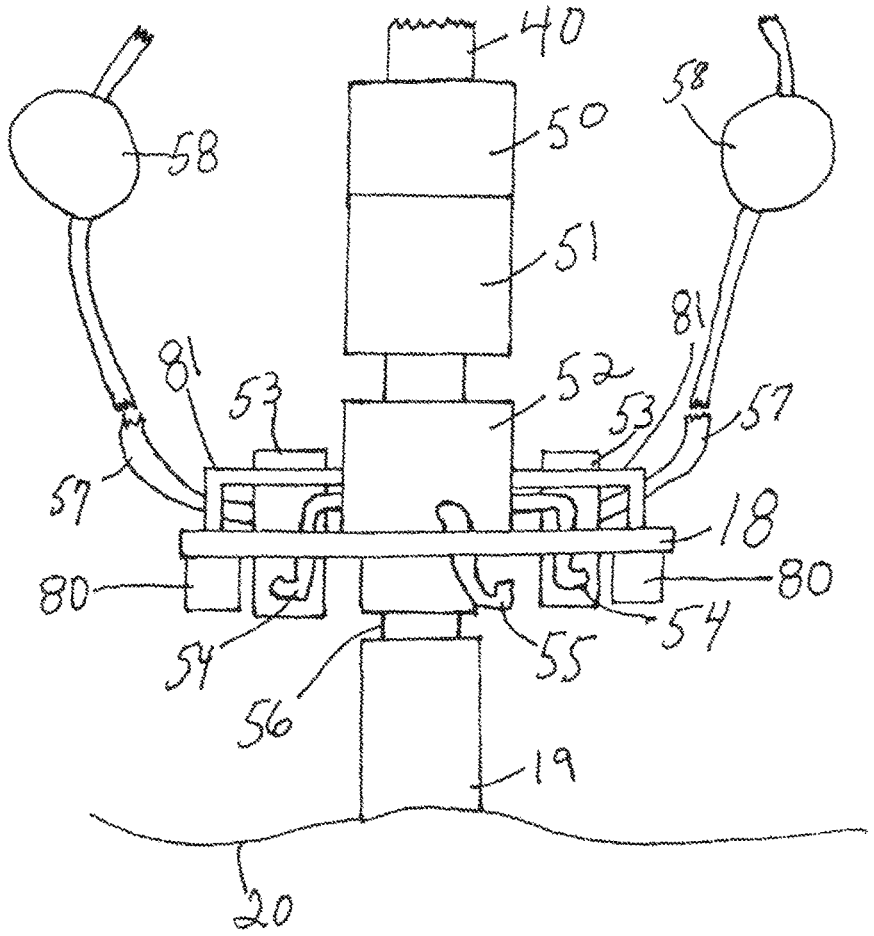
FIG. 11 shows a common oil drilling package comprising a lower marine riser package, a BOP, and a shear module, being a unitization of a seal plate, a dual ram closing system, well bore instrumentation to provide enhanced well control instrumentation, and two dual gradient modules.

The seal plate 18 can be constructed integral to any type of unitized module desired or combination of modules. FIG. 11 illustrates a common drilling package consisting of: a lower marine riser package 50, a BOP 51, and a shear module 52, being a unitization of a seal plate 18, a dual ram closing system, well bore instrumentation to provide enhanced well control instrumentation and two dual gradient modules 53. The dual gradient modules 53 are connected to the shear module 52 with connector pipes 54. The dual gradient modules 53 use a by-pass flowline-riser system for their operations just as that required for well control operations. A hydraulic power riser used in dual gradient drilling can provide the chemical injection delivery system required for well control operations during well control operations. These lines 55 can extend out from the shear module 52. The seal plate 18 is connected to wellhead 56. Flow lines 57 can extend out from the dual gradient modules 53 to pipe risers and be supported by buoyancy devices 58. The shear module 52 can be configured as just an outlet spool (omitting the BOP rams) on the seal plate 18. The dual gradient modules 53 can remain in the circuit during well control operations, or can be removed and the flow lines 57 connected in their stead. The dual gradient modules 53 have booster pumps capable of raising flow line pressure to over 5,000 psi above seafloor pressures. Risers required for the containment system should have a flow rate capacity of 50,000 BOPD at flowing pressure differentials to ambient of up to 2,000-psid. Where these equipment spreads are used for dual gradient drilling support, these risers will need a working pressure of up to 10,000-psid (to ambient).

The control of this containment system can be from BOP systems and/or from risers used to take the by-pass flow to the surface. The risers can be made on site using stalking standards of pipe in a fashion similar to that of the drilling rig operations and in multi-service vessels. The buoyancy devices can be of syntactic foam, air cans, or inflatable balloon-like chambers. These too can be operated by the multi-service vessels. Flexible pipe risers to the surface can be supported by a multi-service vessel with a return line to the drilling rig, in the case of dual gradient drilling, to a tanker, in the case of a well control situation, or to the drilling rig directly in another dual gradient situation.

A BOP Based Containment System

Figure 12:
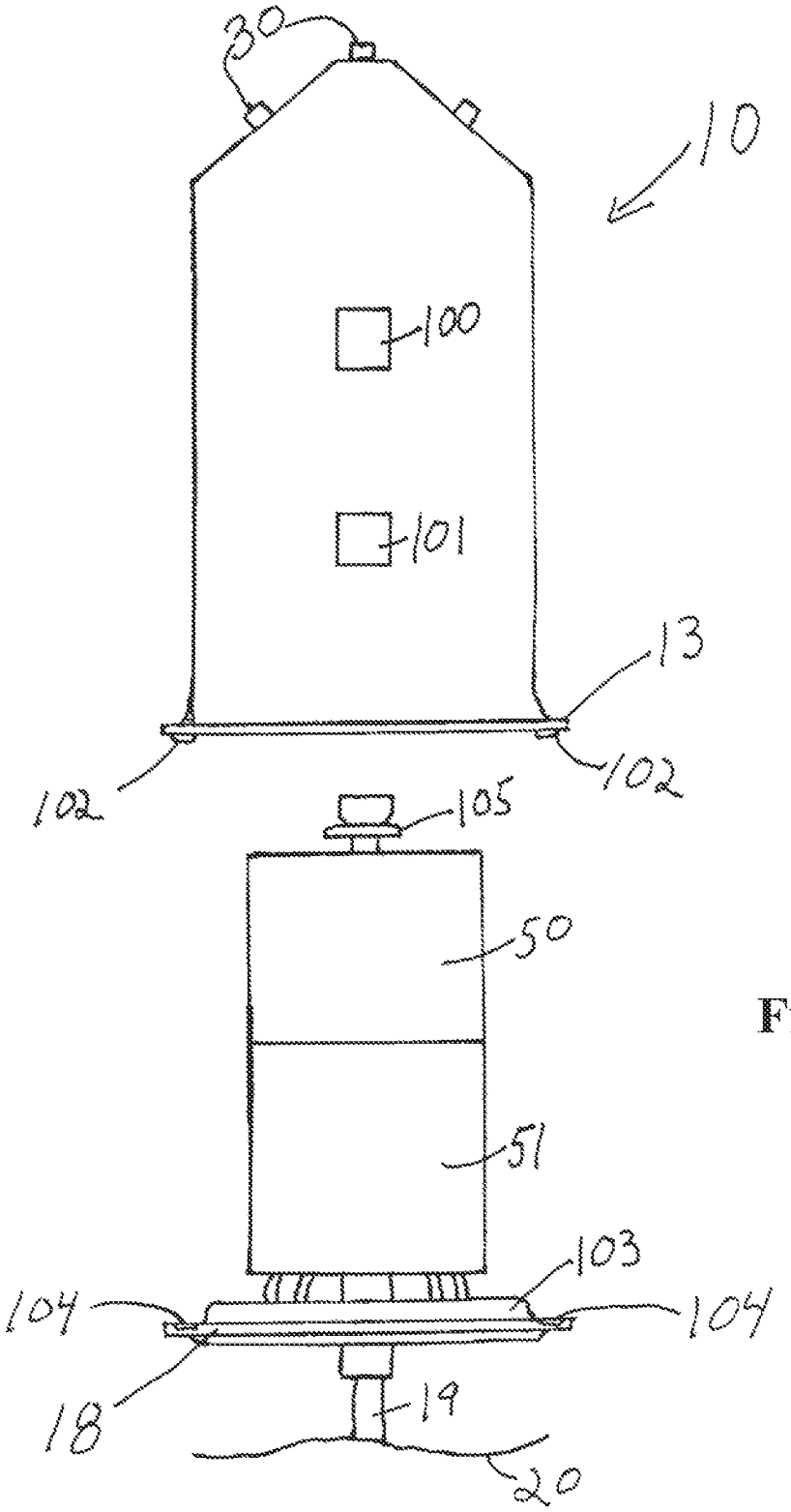
FIG. 12 shows an alternate embodiment wherein external control panels can be attached to the exterior of the containment dome.

A typical well site may have a conductor pipe, a wellhead, a shear module, a BOP, a low marine riser package, and a riser. Encapsulating all these devices within the containment dome may restrict access needed to perform routine operations on these devices, particularly access to standard internal control panels in the shear module and low marine riser package. Therefore, external control panels 80 (see FIG. 11) can be attached to the seal plate 18, and bypass plumbing 81 from the internal standard control panels may be extended through the seal plate 18 to the external control panels 80 for remote operation once encapsulation and containment is achieved. The additional control panels provide operation of all systems that have been encapsulated, including hydraulic power and/or chemical injection. Another embodiment to address the need to access control of the shear module, BOP, and LMRP once they are encapsulated with the containment dome is to integrate exterior control panels into the containment dome structure. FIG. 12 shows external control panels 100 (for the LMRP) and 101 (for the shear module) attached to the exterior of the containment dome 10. The containment dome 10 may have internal plumbing connecting the external control panels 100, 101 to the quick connects 102 located at base 13 of containment dome 10. The seal plate 18 has a conical sealing surface 103 to aid with containment dome alignment. The seal plate 18 has recessed ports 104 located around the top surface of seal plate 18. The recessed ports 104 will accept the quick connects 102 on base 13 of containment dome 10 and provide a path through seal plate 18 for hydraulic power and/or chemical injection to all encapsulated devices. FIG. 12 also displays a typical BOP 51 and LMRP 50 that are to be encapsulated in the event that a leaking component cannot be replaced or repaired without causing additional impact to the environment. FIG. 12 further displays an optional smatter sealing plate 105 located above the LMRP 50 for the purpose of attaching a smaller dome to encapsulate a flex joint and cut off riser.

Figure 13:
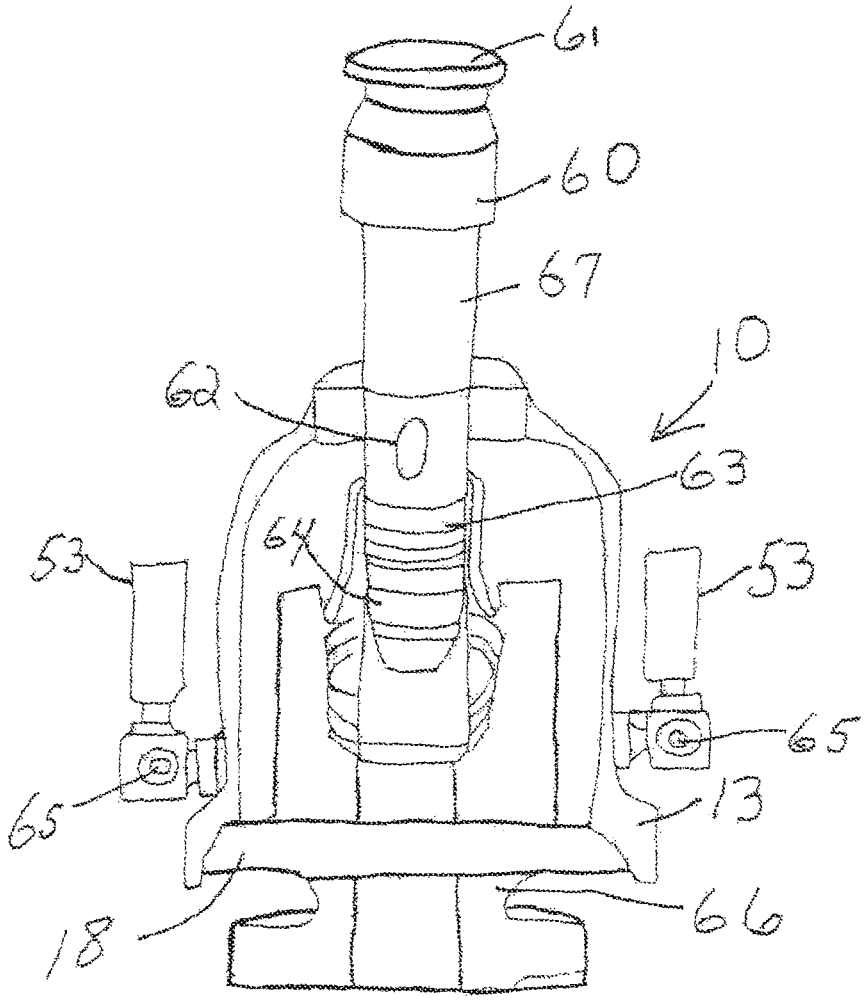
FIG. 13 shows a containment system designed to carry and install a wellhead patch.

FIG. 13 illustrates a containment system designed to carry and install a wellhead patch 60 with the capability of directing well fluids from both the containment dome and/or gripping and sealing within the BOP main bore such that a full working pressure of the BOP can be achieved through the wellhead patch 60 to a reentry or capping stack. FIG. 13 further shows a capping stack interface 61, a rotational valve port 62, a slip assembly 63, a packoff seal 64, bypass flow lines 65 from the dual gradient modules 53, and a stack flex joint 66. The Wellhead patch is integral with the containment dome and is thus run as one unit. It can be attached on a casing riser 67 or be attached beneath the capping stack. Once the containment dome is landed, the patch extends into the BOP to lock and seal to the bore. The side port 65 continues to allow containment based bypass flows until the vertical tie back determines well integrity level and, thus, defines the way forward. With a capping stack, the side ports can be closed to give full pressure integrity to the vertical access, and well control procedures can begin. This configuration facilitates holding greater than 2000-psi in the containment dome. The wellhead patch generates the required bore of 9" for entry to the 9⅝" casing, or 12¾" for entry into the 13⅜" casing string.

Figure 14:
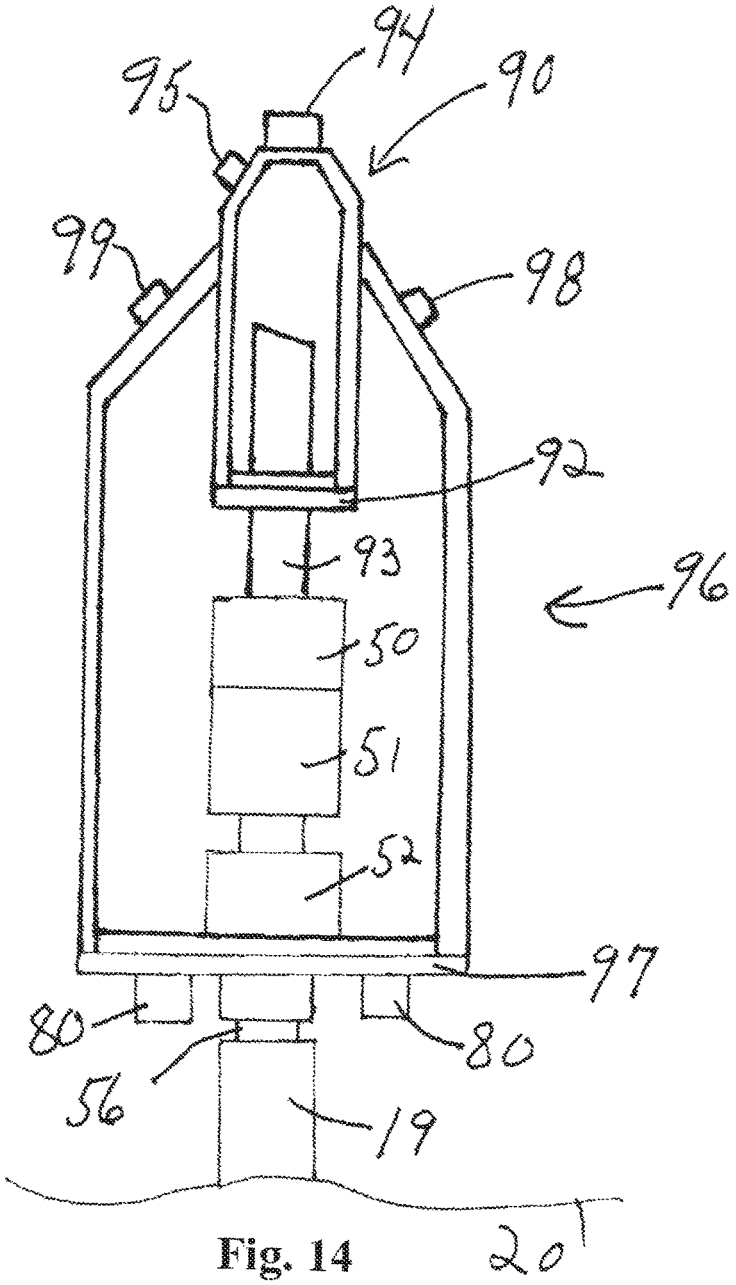
FIG. 14 shows a combination of a portion of a small containment dome contained within a larger containment dome.

FIG. 14 illustrates a combination of a portion of a small containment dome 90 contained within a larger containment dome 96. The smaller dome 90 is shown enclosing a marine riser 93, and having a main high pressure flow line 94 and a bypass line 95. The small containment dome 90 is attached to flange seal plate 92. The larger containment dome 96 is shown as having a main low pressure flow line 98, a bypass line 99, and enclosing a low marine riser package (LMRP) 50, a BOP 51, and a shear module 52. The larger containment dome 96 is attached to seal plate 97.

The smaller containment dome system uses a containment dome greatly reduced in size compared to the larger containment dome, and the seal plate 92 is integrated permanently into the drilling riser system. This system addresses the control of the well bore only, eliminating the complexities of well control and control system intervention. In this system the seal plate 92 is integrated into the marine riser above a lower flex joint or the top of the (LMRP). The containment domes and the seal plates are passive devices in terms of well control and form an emissions control from the perspective of the riser only.

This containment system having the smaller containment dome provides a narrow level of encapsulation while facilitating the establishment of well control through the total BOP assembly. The containment domes have the required guidance, locking, sealing and intervention functions to effectively capture and divert well effluent to a surface recovery vessel, and permit the safe re-entry of tools into the well bore for well control operations. The riser systems are either integral to the containment dome handling system, or horizontal take-offs to independent risers, for the recovery of the produced fluids. Surface systems are capable of processing a water-hydrocarbon mixture, stripping water, and storing and offloading hydrocarbon. A suite of robotic tools enable the access of the containment dome to the (LMRP)-based seal plate, establishing control of the BOP via ROV control panels and providing essential observation and instrumentation of the field operations at the well site. This containment system is compatible with all shore base facilities required to support equipment availability.

The use of this containment system involves the permanent installation of the seal plate into all deepwater and high risk drilling BOPs prior to the installation of the BOP on the wellhead. As such, the equipment is a permanent part of such BOP. The containment dome can be sized to be a "one size fits all" design, as there is little variance in flex joint design, and a standard for industry wide use could be easily defined. The upper interface of the containment dome may include an 18¾" housing profile on a spool capable of engaging the bore of the dysfunctional BOP assemblage, sealing to the BOP bore, and enabling a capping stack to be connected and pressure tested.

The fundamental basis for the use of this containment system is that the BOP controls and Marine Riser have been severed, forming a debris field issuing from the well site and necessitating the removal of the riser remnant and the production of a capping stack interface to the top of the LMRP. This also assumes that the LMRP cannot be easily/safely removed from the lower stack.

As in any situation where riser or umbilical debris has buckled and fallen over the BOP, this debris must first be cut away and removed from the well site. A probable point of failure is the upper neck of the flex joint, where maximum bending stresses occur when the riser buckles. Buckling of the neck section will require the cutting of this pipe section to permit a full bore entry to the BOP well bore.

Once clear access is achieved, the containment dome is lowered to a close proximity to the stricken BOP. By-pass flow lines and chemical injection lines are connected to the containment dome via independent risers. The containment dome is addressed to the BOP and landed while MeOH or other inhibitors are pumped into the containment dome to minimize hydrate formation. The containment dome base is latched and locked to the seal plate. By-pass flows are stimulated by constriction of the open capping stack bore and/side outlets. The well bore is interrogated using survey tools to determine the extent of damage to the well, and therefore the best approach to the well kill operations. Should well integrity be confirmed, the wellhead patch is engaged in the stricken BOP bore (a hydraulic ram based operation) and the pack-off seals and slip system set and tested. The side ports in the wellhead patch should be closed after the capping stack has been sealed and outlet lines to the well control system tested and verified as functional. Well kill operations can then begin.

The containment dome is not intended to support full shut-in pressure, however these pressure loads are possible. This task is reserved for an upper spool of the containment dome after it is inserted into the bore of the BOP and its seals are energized. A series of well integrity tests must be performed on the well before closure of the upper spool side ports is possible. At that time the ports are closed and by-pass flows via the off-take lines can be stopped and full well control can be established through the capping stack.

The containment dome (as in FIG. 13) can be manipulated or run by a multitude of vessels, but as the containment dome is small enough to be operated through a rig's moon pool, and as this class of vessel has deck load capacity for fluid processing, a drilling rig is likely to be more efficient in the delivery of the containment dome to the BOP. The running system also serves as the tool to install the upper spool of the containment dome into the LMRP bore where the spool seals are energized and the seal pressure tested to full well rated pressure.

The drilling rig runs the handling tool and capping stack on the marine riser, and, with all side ports open to the environment and the capping stack equally open to the environment, engages the 18¾"-15-ksi spool profile on top of the containment dome. Kill and choke lines of the marine riser can (in measured circumstances) be used because the flow bypass lines or vent valves on the upper spool can be opened to ensure a low pressure engagement of the containment dome to the upper spool.

Though the upper spool to which the capping stack is attached will reduce the bore of the dysfunctional BOP, it will allow tools to be passed through, (by stripping through the capping stack's annular preventers) and into the well bore. This assumes that the well bore is passable and is not littered with debris to prevent standard clearing and kill operations to proceed.

Figure 15:
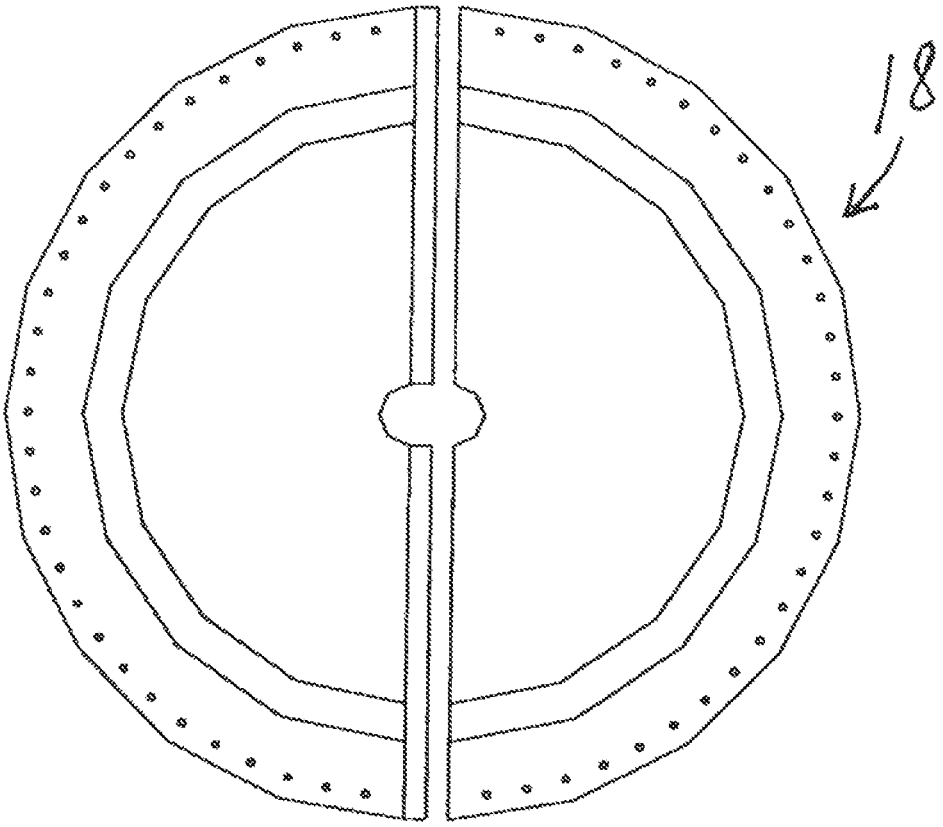
FIG. 15 shows a seal plate sectioned into two equal halves.
Figure 16:
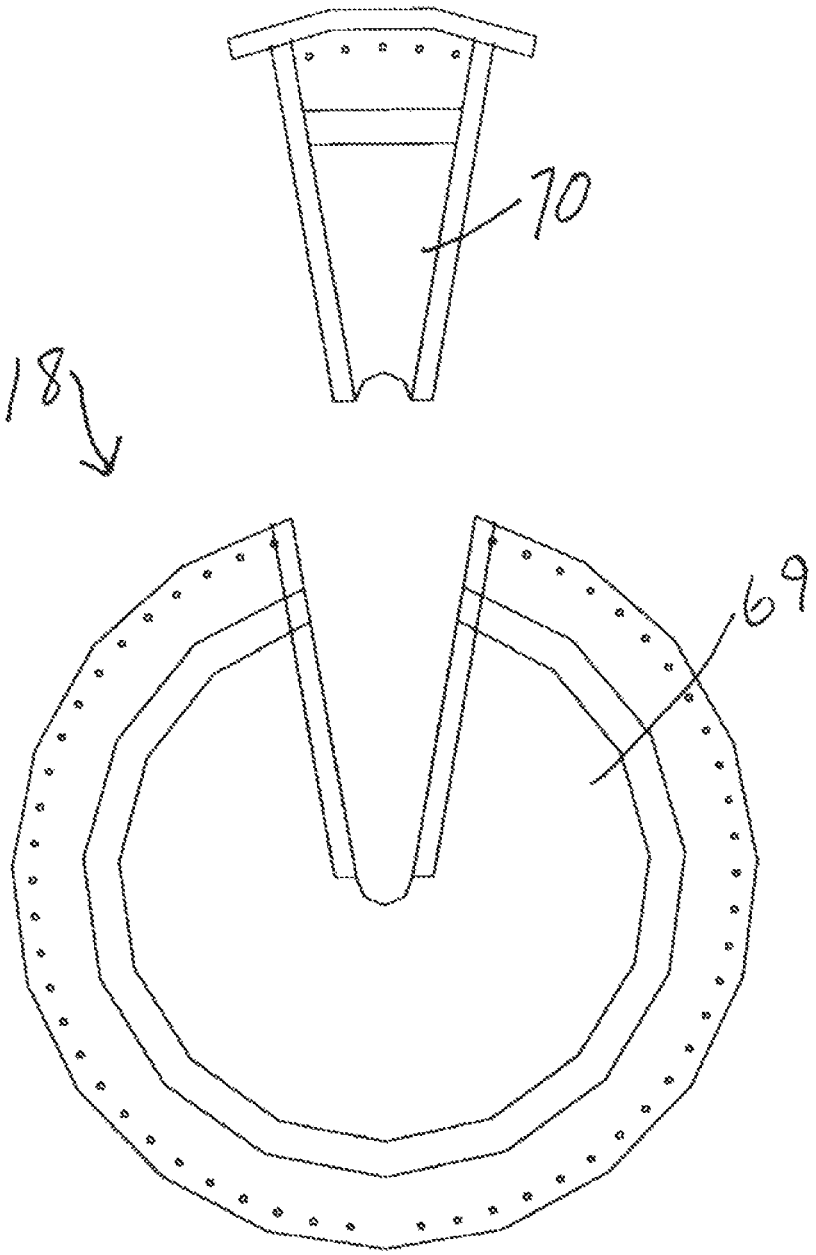
FIG. 16 shows a seal plate divided into a larger section and a smaller section.
Figure 17:
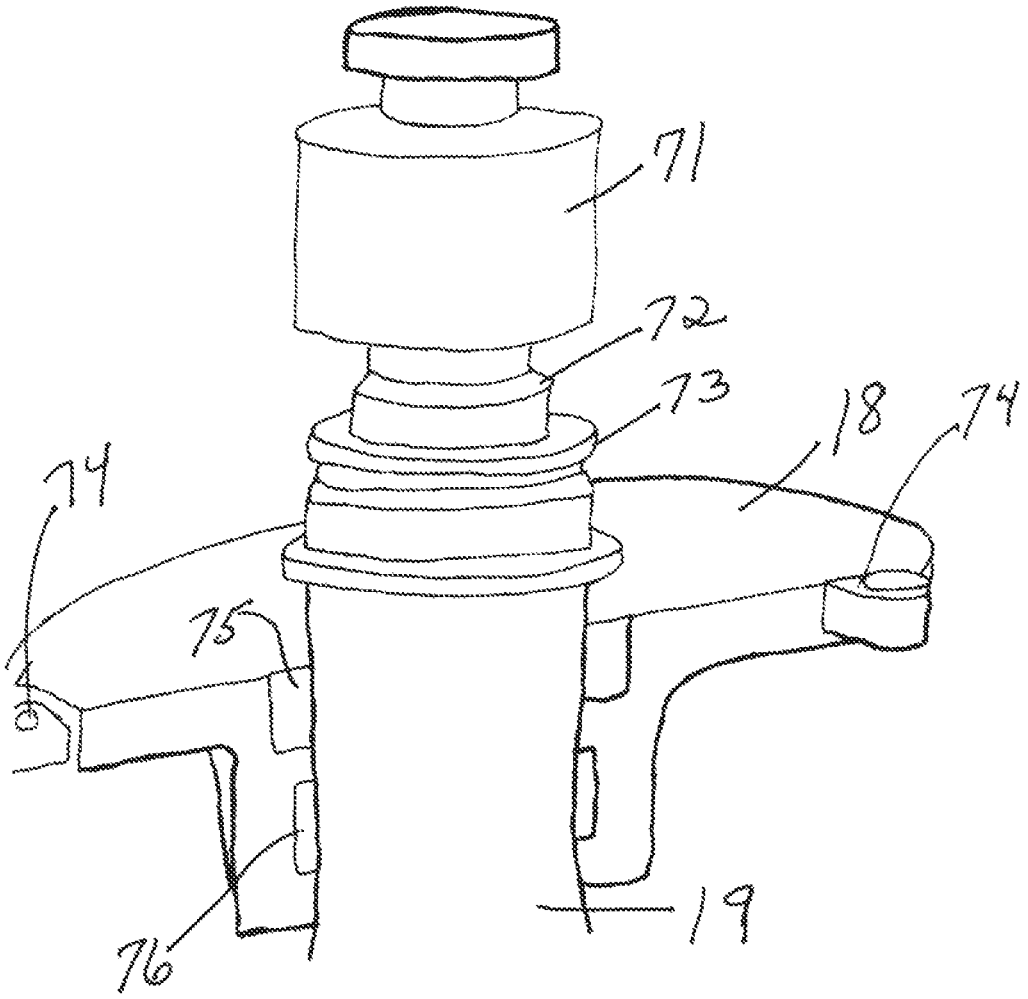
FIG. 17 shows a half section of a seal plate in position around a casing.

FIG. 15 shows the seal plate 18 sectioned into two equal halves. The seal plate 18 can be constructed into sections to be positioned around a pipe or casing. FIG. 16 shows a seal plate 18 divided into a larger section 69 and a smaller section 70. FIG. 17 shows an illustration of a half section of a seal plate 18 in position around a casing 19. FIG. 17 further shows a BOP connector 71, a high pressure wellhead 72, a low pressure wellhead 73, hinge lock pockets 74 for connecting one half of the section plate 18 to the other half, packing or an inflatable seal 75 between the plate 18 and casing 19, and a slip assembly 76. The segmented seal plate 18 in two pieces may be hinged on one side and bolted or pinned on the other side, creating compression around a riser pipe or casing.

The method of deploying the containment system of the present invention begins by installing a seal plate on a wellhead prior to drilling operations. The drilling rig BOP and marine riser system are positioned on and attached to the top interface of the seal plate. The seal plate has compatible connections with BOP and marine riser systems to allow remote operation through the seal plate and/or containment dome once containment or encapsulation has occurred. By installing a two-piece seal plate to existing wells the existing BOP and marine riser package on those wells may still be used and be protected by the containment system. In addition, a smaller seal plate may be installed at the flex joint of a marine riser prior to drilling operations or even on existing operating wells. The smaller seal plate allows for a smaller containment dome to encapsulate the cutoff riser pipe instead of encapsulating BOP and marine riser.

Once the seal plates are installed, all components on the seal plates are capable of being stored, installed, and operated by either the offshore drilling rig attached to the wellhead or a primary intervention vessel with lesser capabilities, but one with greater agility and range of motion than the offshore drilling rig which will be essentially tied to the immediate wellhead location.

The containment system may be stored on an offshore drilling rig ready for immediate deployment in the event of a catastrophic blowout of the oil well. In an emergency situation the drilling rig is designed to disconnect from the riser and position itself out of harm's way. Once the damage has been assessed the drilling rig may return to the site and the containment dome can be deployed to encapsulate the leaking structure below.

Containment domes can be stored at warehouse facilities having quick access to the ocean, or even on a primary intervention vessel that is on standby, in the event the offshore drilling rig is dysfunctional or even destroyed. Additional emergency response vessels may be used to clean debris around BOP and marine riser packages. Once a debris field is removed the (primary intervention vessel may lower the containment dome over the side of ship or through a moon pool and connect it to the seal plate located below the BOP and marine riser packages. Remote operating vehicles (ROVs) may be deployed to aid in the alignment and securing of the containment dome and the seal plate. With the containment dome attached, the well flow may be shut off or redirected with bypass risers attached to the containment dome. The bypass risers can regulate internal pressures of the containment dome and direct flow to the surface where the flow is collected by shuttle tankers and/or processing stations.

The foregoing description has been limited to specific embodiments of this invention. It will be apparent, however, that variations and modifications may be made, by those skilled in the art, to the disclosed embodiments of the invention, with the attainment of some or all of its advantages and without departing from the spirit and scope of the present invention. For example, any types of suitable metals and plastics may be used in the construction of the seal plate and containment dome. The seal plate and containment dome may be locked together in addition to being compressed together. The seal plate and containment dome may be constructed in any suitable shape.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. A drilling package for an offshore wellbore having a wellhead, said drilling package comprising:

a shear module positioned above the wellhead and in fluid communication with the offshore wellbore;

a blowout preventer in fluid communication with the shear module;

a lower marine riser package in fluid communication with the blowout preventer;

a seal plate attached to said wellhead subjacent to said shear module, wherein said seal plate is configured to engage a containment dome so as to collect and control fluid leaks from said drilling package; and a bypass valve and port in fluid communication with the containment dome configured to divert fluid flow from the blowout preventer to an alternative flow path.

2. The drilling package of claim 1, wherein said shear module comprises one or more shear rams capable of isolating said offshore wellbore.

3. The drilling package of claim 1, further comprising one or more dual gradient modules in fluid communication with said offshore wellbore.

4. The drilling package of claim 3, wherein said dual gradient modules are connected to said shear module by connector pipes.

5. The drilling package of claim 3, further comprising flow lines extending from said one or more dual gradient modules to a riser pipe in fluid communication with said offshore wellbore.

6. The drilling package of claim 5, wherein said flow lines are supported by buoyancy devices.

7. The drilling package of claim 1, further comprising control panels for said shear module.

* * * * *